United States Patent [19]

Brakel

[11] 3,976,097

[45] Aug. 24, 1976

[54] HYDRAULIC CONTROL ARRANGEMENT

[75] Inventor: Kornelius Brakel, Schwieberdingen, Germany

[73] Assignee: Robert Bosch G.m.b.H., Stuttgart, Germany

[22] Filed: Dec. 4, 1975

[21] Appl. No.: 637,855

[30] Foreign Application Priority Data

Dec. 5, 1974 Germany ..... 2457451

[52] U.S. Cl. ..... 137/596.13; 91/411. R; 91/414; 91/448; 91/446

[51] Int. Cl.[2] ..... F15B 13/04

[58] Field of Search ..... 137/596.13; 91/411 R, 91/414, 446, 448

[56] References Cited

UNITED STATES PATENTS

| | | | |
|---|---|---|---|
| 3,411,295 | 11/1968 | Byers, Jr. | 91/414 |
| 3,520,231 | 7/1970 | Genz | 91/414 |
| 3,592,216 | 7/1971 | McMillen | 91/414 |
| 3,851,566 | 12/1974 | Herrmann | 91/414 |

*Primary Examiner*—Martin P. Schwadron
*Assistant Examiner*—Abraham Hershkovitz
*Attorney, Agent, or Firm*—Michael J. Striker

[57] ABSTRACT

A hydraulic control arrangement for control of fluid flow to a consumer device and comprising a three-position valve having a valve member movable between a neutral position closing at least one conduit leading to the consumer device and two working positions in one of which it connects the consumer device with a source of pressure fluid and in the other of which it connects the consumer device with a return flow conduit leading to a reservoir, a reversing valve for connecting the source of pressure fluid directly to the return flow conduit and a control conduit connected with the reversing valve. A throttle is provided in the control conduit which produces a pressure difference which can act on the valve member of the reversing valve to move the latter against the force of a spring, and the arrangement includes further means for control of the consumer device independent of the load pressure acting thereon.

9 Claims, 1 Drawing Figure

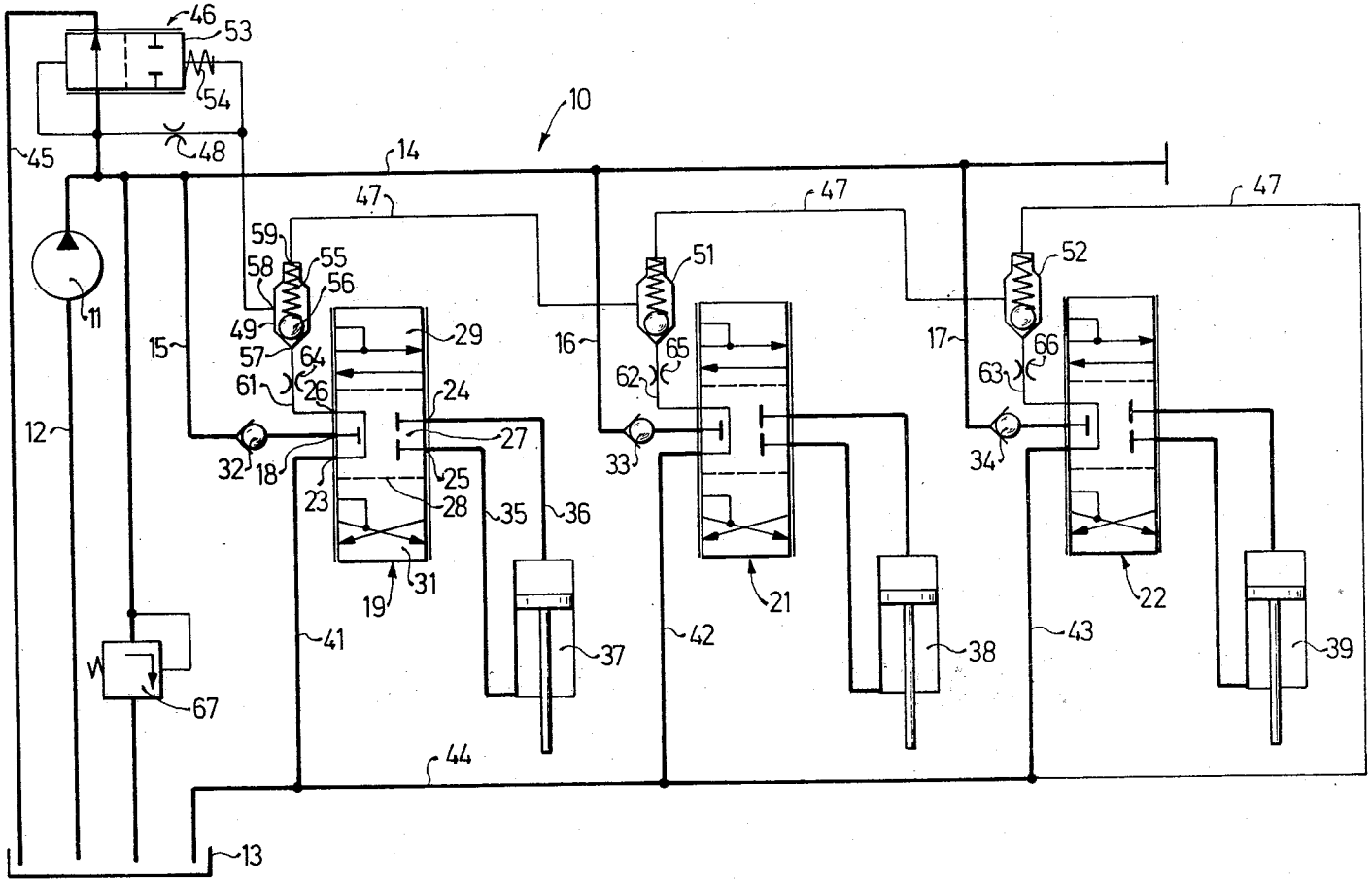
10
11
12
13
14
15
16
17
18
19
21
22
23
24
25
26
27
28
29
31
32
33
34
35
36
37
38
39
41
42
43
44
45
46
47
48
49
51
52
53
54
55
56
57
58
59
61
62
63
64
65
66
67

HYDRAULIC CONTROL ARRANGEMENT

BACKGROUND OF THE INVENTION

The present invention relates to a hydraulic control arrangement for control of fluid flow to and from a consumer device. The arrangement comprises a three-position valve having a valve member movable between a neutral position closing at least one conduit leading to the consumer device and two working positions respectively connecting the consumer device with a source of pressure fluid and to a return flow conduit leading to a reservoir, a reversing valve for connecting the source of pressure fluid directly to the return flow conduit and a control conduit connected with the reversing valve. A throttle is provided in the control conduit which produces a pressure difference which can act on the valve member of the reversing valve to move the latter against the force of a spring, and means for control of the consumer device independent of the load pressure acting thereon.

In a hydraulic control arrangement of the aforementioned kind two control conduits are provided, both of which are controllable from the valve member of a three-position valve. A first one of the control conduits, provided with a throttle, is controlled from the valve members of all three-position valves and serves for control of the reversing valve, whereas the second control conduit serves for return of the load pressure from the consumer devices. Due to the necessity of two control conduits, this known arrangement is extremely expensive to produce and it requires three control connections at each three-position valve. This arrangement has the further disadvantage that during simultaneous operation of two three-position valves the control of the consumer devices connected thereto will be detrimentally influenced. The known control arrangement includes further a check valve in the second control conduit which prevents return flow of pressure fluid from the consumer device to the reversing valve. In this arrangement it may happen that the lowering of the load occurring during such return flow is in practice negligibly small, but that the pressure built up to control the reversing valve, is due to the check valve, only possible from the side of the pump providing the necessary pressure fluid and that this lowering of the load will therefore occur slower than in an arrangement which omits this check valve.

SUMMARY OF THE INVENTION

It is an object of the present invention to provide a hydraulic control arrangement of the aforementioned kind which avoids the disadvantages of the above-described known control arrangement.

It is a further object of the present invention to provide a control arrangement of the aforementioned kind which is simple in construction and which will operate trouble free under extended use.

These objects are obtained according to the present invention by providing in the control conduit downstream of the throttle therein a two-way valve having a valve member which in a rest position closes a first outlet of the two-way valve which is connected to a control connection of the three-position valve, that the two-way valve has an inlet located between the two outlets thereof and connected with a portion of the control conduit leading to the reversing valve, that the two-way valve has a second outlet which is connected with a portion of the control conduit which leads to the reservoir and that the control conduit connection of the three-position valve is connected in at least one working position of the latter together with the inlet connection of the three-position valve with a consumer device connection of the latter.

This arrangement needs therefore only a single control conduit which serves at the same time for control of the reversing valve and for return of the load pressure from the consumer device. In this control arrangement the three-position valve can be constructed simpler and more compact than in the arrangement known in the art since the three-position valve will require only a single connection for the control conduit. A further advantage of the control arrangement according to the present invention is that during simultaneous operation of two, in parallel connected, three-position valves the operation of the consumer devices connected thereto will not be detrimentally influenced. Furthermore the control arrangement according to the present invention will assure that the control of the consumer devices will proceed faster than in the arrangement known in the art.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE of the drawing illustrates the control device according to the present invention in a schematic manner.

DESCRIPTION OF THE PREFERRED EMBODIMENTS

Referring now to the drawing, it will be seen that the control arrangement 10 comprises a pump 11 which sucks pressure fluid through a conduit 12 from a reservoir 13 and pumps the pressure fluid into a conduit 14. Three branch conduits 15, 16 and 17, branching off from the conduit 14, respectively lead to inlet connections 18 of a first, second and third three-position valves 19, 21 and 22 which are connected in parallel to each other. The three-position valves 19, 21 and 22 are of the same construction so that in the following only the first three-position valve 19 will be described in further detail. The three-position valve 19 has in addition to the inlet connection 18 a return flow connection 23, a first consumer device connection 24 and a second consumer device connection 25, as well as a control conduit connection 26. In the illustrated neutral position 27 of the valve member 28 of the three-position valve, the consumer device connections 24 and 25 as well as the inlet connection 18 are blocked and the control conduit connection 26 is connected with the return conduit connection 23. In a first working position 29 of the valve member 28, the inlet connection 18, the first consumer device connection 24 and the control connection 26 are connected to each other, whereas the second consumer device connection 25 is connected to the return flow connection 23. In the second working position 31 of the valve member 28 the inlet connection 18 and the control connection 26 are connected to the second consumer connection 25 whereas the first consumer connection 24 is connected to the return flow connection 23. Check valves 32, 33 and 34 are respectively arranged in the branch conduits 15, 16 and 17 which permit pressure fluid to flow from the pump through the respective branch conduit to the inlet connection 18 of the respective three-position valve while preventing return flow through the respective branch conduit. The return flow connections 23 of the three-position valves 19, 21, 22 are respectively connected through return branch conduits 41, 42 and 43 with a common return conduit 44 which leads to the reservoir 13.

A bypass conduit 45 leading to the reservoir 13 branches off from the conduit 14 and reversing valve 46 is provided in this bypass conduit. A control conduit 47 branches off from the bypass conduit 45 upstream of the reversing valves therein and this control conduit is connected to opposite ends to the reversing valve 46 and leads further, downstream of a throttle 48 provided therein, over a first two-position valve 49, a second two-position valve 51 and a third two-position valve 52 to the common return flow conduit 44. The reversing valve 46 has a valve member 53 biased by a spring 54 to a position in which flow of fluid from the pump 11 into the bypass conduit 45 is interrupted, whereas the pressure difference produced by the throttle 48 acts against the force of the spring 54 to maintain the position of the valve member 53 of the reversing valve 46 in the position as shown in the drawing, permitting flow from the pump 11 through the bypass conduit 45 to the reservoir 13.

The three above-mentioned two-way valves 49, 51 and 52 are of the same construction and respectively coordinated with the three-position valves 19, 21 and 22. Each of the two-way valves has a pair of opposite seats 57 and 59 and an inlet 58 between the seats and connected to the control conduit 47. Each of the two-position valves further includes a valve member in form of a ball 56 biased by a spring 55 against the valve seat 57 to close the outlet formed thereby so that fluid flowing through the inlet 58 may pass through the other outlet 59. The first outlets 57 of the two-way valves 49, 51 and 52 are respectively connected over a conduit 61, 62 and 63 with the control circuit connections 26 of the three-position valves 19, 21 and 22 and second throttles 64, 65 and 66 are respectively provided in the conduits 61, 62 and 63. The inlets 58 of all two-way valves 49, 51 and 52 are respectively connected with the portion of the control conduit 47 downstream of the throttle 48 whereas the second outlets 59 are respectively connected directly or indirectly over the two-way valves 49 and 51 with the portion of the control conduit 47 which leads to the common return flow conduit 44. The conduit 14 is further connected over an overpressure valve 67 with the reservoir 13.

The valve member 28 regulates during its movement from its neutral position 27 to the respective working position 29 or 31 flow of pressure fluid through the connection established in the respective working position in a stepless manner from a smallest to a largest value and forms thereby an adjustable third throttle. The pressure drop occurring at the third throttle has during a nominal flow of pressure fluid through the three-position valve a predetermined value, for instance 8 bars. The pressure drop produced by the first throttle 48 and the respective second throttles 64, 65 and 66 are such that the sum of the pressure drops produced thereby is at least equal or greater than the pressure drop produced by the third throttle. The pressure drop produced by the first throttle 48 should be held as small as possible, especially smaller than the pressure drop produced by each of the second throttles 46, 65 or 66 and for instance the pressure drop produced by the first throttle 48 should two bars and the pressure drop produced by each of the second throttles 6 bars.

The above-described control arrangement 10 will operate as follows:

In the shown neutral position of all valve members 28 of the three-position valves 19, 21 and 22 flow of pressure fluid from the pump 11 to the consumer devices 37, 38 and 39 is interrupted and so is the flow of fluid form the consumer devices to the common return flow conduit 44. The oil pumped by the pump 11 will flow in the neutral position of the three-position valves to a small part through the control conduit 47 and the two-way valves 49, 51 and 52 therein to the common return flow conduit 44. The pressure drop thereby occurring at the first throttle 48 will hold the valve member 53 of the reversing valve 46 against the forece of the spring 54 in the position as shown in the drawing so that the major portion of the oil pumped by the pump 11 will flow over the reversing valve 46 and the bypass conduit 45 to the container 13, whereby a pressure drop of for instance two bar will will occur at the reversing valve 46.

If now the valve member 28 of the three-position valve 19 is moved from its neutral position 27 towards its first working position 29 while at the same time a load acts on the piston rod 37' of the consumer device 37, then a corresponding load pressure will be produced in the conduit 36, the first consumer connection 24 and the inlet connection 18 of the valve 19. This thus produced pressure will normally be greater than the circulation pressure of 2 bars so that the check valve 32 will be closed. Due to the prevailing pressure difference a relative small stream of oil will at the beginning flow from the consumer device 37 over the control circuit connection 26, the conduit 61, the first two-way valve 49 and the first throttle 48 to the bypass conduit 45. The reversing valve 46 will throttle thereby quickly flow of oil into the bypass conduit or completely prevent such flow so that pressure can build up by the pump. The ball 56 is moved under the influence of the load pressure against the second seat 59 in the two-way valve 49 preventing thereby flow of oil through the portion of the control conduit 47 downstream of the valve 49 to the common return flow conduit 44. After the pressure built up by the pump is at least equal to the load pressure in the consumer device 37, oil will flow through the conduit 14, the branch conduit 15, the check valve 32, the three-position valve 19 and the conduit 36 to the consumer device 37. Nominal flow will be reached only when the pressure produced by the pump is at least equal to the load pressure and the pressure drop in the valve 19. Simultaneously with flow of oil under pressure through the conduit 36 into the consumer device 37 oil will flow therefrom through the conduit 35, the three-position valve 19, the return conduit 42 to the common return flow conduit 44 and from there into the reservoir 13. At the same time a small partial stream of oil will flow from the pump 11 over the first throttle 48, the two-way valve 49, the second throttle 64, the control conduit connection 26 to the first consumer device connection 24. The pressure drop occurring thereby at the first throttle 48 will act on the valve member 53 of the reversing valve 46 so that the amount of pressure fluid not needed by the consumer device 37 may flow to the container 13. The valve member 53 of the reversing valve 46 will throttle, at increasing loads acting on the consumer device 37 flow of pressure fluid through the reversing valve and the return conduit 45 to the reservoir 13 to an increasing extent and at diminishing load to a diminishing extent so that at a certain position of the valve member 28 the pressure drop occurring therein will remain constant and therewith the consumer device 37 will be controlled independent from the load acting thereon.

The pressure drop produced by the valve member 28 during its movement away from the neutral position will vary between a maximum and a minimum value, whereby the amount of pressure fluid flowing to the consumer device 37 will be regulated proportional to the movement of the valve 28 away from its neutral position. During movement of the valve member 28 in the direction toward the second working position 31 thereof the consumer device 37 will correspondingly be controlled in a reverse manner, whereby the piston rod 37' will move into the cylinder 37'' of the consumer device 37.

If two parallel connected three-position valves, for instance the three-position valves 19 and 21 are simultaneously actuated, then the greater load pressure acting on the consumer device 37 or 38 will be transmitted over the control conduit 47 and the two two-way valves 49 and 51 to the reversing valve 46 and thereby a corresponding pump pressure throttled. Whereas the consumer device with the greater load will be controlled independent from the load pressure acting thereon, the control of the consumer device with the smaller load acting thereon will be subjected to a load pressure depending influence, the value of which will depend on the difference of the two load pressures respectively acting on the consumer device 37 and 38.

The correlation of the pressure drop produced by the throttles 48, 64, respectively 19 permits despite the load independent control, on the one hand a very low circulation of pressure fluid when all of the valves 19, 21 and 22 are in the neutral position, and on the other hand a relatively large flow of pressure fluid through an actuated three-position valve when the third throttle constituted by the valve member of the respective three-position valve produces a relatively large pressure drop.

It will be understood that each of the elements described above, or two or more together, may also find a useful application in other types of hydraulic control arrangements differing from the types described above.

While the invention has been illustrated and described as embodied in a hydraulic control arrangement, it is not intended to be limited to the details shown, since various modifications and structural changes may be made without departing in any way from the spirit of the present invention.

Thus for instance the control arrangement according to the present invention can also be used on a consumer device differing from the consumer devices shown in the drawing by corresponding change of the valves 19, 21 or 22. It is also possible to use a different valve in the bypass conduit or to connect the bypass conduit not to a reservoir from which pressure fluid is pumped by the pump. Under certain conditions it may also be advantageous to provide in the control conduit 47 a check valve adjacent to the throttle 48 in order to prevent return flow of pressure fluid through the control conduit from the consumer device into the conduit 14 without preventing action of the pressure difference produced by the throttle 48 on the reversing valve 46.

Without further analysis, the foregoing will so fully reveal the gist of the present invention that others can, by applying current knowledge, readily adapt it for various applications without omitting features that, from the standpoint of prior art, fairly consitute essential characteristics of the generic or specific aspects of this invention.

What is claimed as new and desired to be protected by Letters Patent is set forth in the appended claims.

1. Hydraulic control arrangement for controlling a flow of fluid from a pump to a consumer device independent of the load acting on the latter and from the consumer device to a reservoir, comprising, in combination, a three-position valve having an inlet connection, a return flow connection, first and second consumer device connections and a control circuit connection, said three-position valve having a valve member movable between a neutral position preventing flow between the inlet connection to at least one of said consumer device connections, a first working position connecting said inlet connection with the first consumer device connection and said second consumer device connection with said return flow connection, and a second working position connecting said inlet connection with said second consumer device connection and said first consumer device connection with said return flow connection; a first conduit connecting the pump with said inlet flow connection; a second conduit connecting said first consumer connection with said consumer device; a third conduit connecting said second consumer connection with said consumer device; a fourth conduit connecting said return flow connection with the reservoir; a bypass conduit connecting said first conduit upstream of the three-position valve with said reservoir; a reversing valve in said bypass conduit having a valve member movable between a first position permitting flow of fluid from said pump through said bypass conduit to said reservoir and a second position preventing such flow, and spring means biasing said valve member of said reversing valve to said second position; a control conduit connected to said first conduit and having a portion connected with opposite ends of said reversing valve; a throttle located in said control conduit portion and producing a pressure difference biasing said valve member of said reversing valve against the pressure of said spring means to said first position; a two-way valve having an inlet connected downstream of said throttle to said portion of said control conduit, a pair of seats to opposite sides of said inlet and forming outlets of said two-way valve, a valve member movable between said seats for respectively closing said outlets and abutting in a rest position against one of said seats for closing the corresponding one of said outlets, said control conduit connection to said three-position valve being connected with said one outlet, and said control conduit having a further portion connecting the other outlet of said two-way valve with said reservoir, said control conduit connection of said three-position valve being in at least one of said working positions of the latter connected with one of said consumer connections which is connected in this position of the three-position valve with said inlet connection.

2. A control valve arrangement as defined in claim 1 and including a second throttle between said one outlet of said two-way valve and that control conduit connection of said three-position valve.

3. A control valve arrangement as defined in claim 2, wherein said second throttle is constructed to produce a greater pressure drop than said first-mentioned throttle.

4. A control valve arrangement as defined in claim 2, wherein said valve member for said three-position valve forms a third throttle and wherein the sum of the pressure drops produced by said first and second throttle is at least equal to the pressure drop produced by said third throttle, as considered for a nominal flow of fluid through said arrangement.

5. A control valve arrangement as defined in claim 2, wherein said valve member of said three-position valve forms a third throttle and wherein the sum of the pressure drops produced by said first and second throttle is greater than the pressure drop produced by said third throttle as considered for a nominal flow of fluid through said arrangement.

6. A control valve arrangement as defined in claim 1, and including at least a second three-position valve connected in parallel with said first-mentioned three-position valve and a second two-way valve coordinated therewith, the inlet of said second two-way valve being connected to the other of said outlets of said first-mentioned two-way valve.

7. A control valve arrangement as defined in claim 1, wherein in said neutral position of said three-position valve, said control circuit connection thereof is connected with said reservoir.

8. A control valve arrangement as defined in claim 1, and including a spring biasing said valve member of said two-position valve against said one seat.

9. A control valve arrangement as defined in claim 6, wherein the other outlet of said second two-way valve is connected to said further portion of said control conduit leading to said reservoir.

* * * * *